US008517628B2

(12) United States Patent
Weiser et al.

(10) Patent No.: US 8,517,628 B2
(45) Date of Patent: Aug. 27, 2013

(54) ROAD FINISHER WITH AUTOMATIC ENGINE CONTROLLER

(75) Inventors: Ralf Weiser, Ladenburg (DE); Tobias Noll, Roschbach (DE); Martin Buschmann, Neustadt (DE); Achim Eul, Mannheim (DE)

(73) Assignee: Joseph Vögele AG, Ludwigshafen/Rhein (DE)

( * ) Notice: Subject to any disclaimer, the term of this patent is extended or adjusted under 35 U.S.C. 154(b) by 250 days.

(21) Appl. No.: 12/821,970

(22) Filed: Jun. 23, 2010

(65) Prior Publication Data

US 2010/0329783 A1 Dec. 30, 2010

(30) Foreign Application Priority Data

Jun. 26, 2009 (EP) ..... 09008415

(51) Int. Cl.
*E01C 23/07* (2006.01)

(52) U.S. Cl.
USPC ..... 404/84.05; 701/50

(58) Field of Classification Search
USPC ..... 404/84.05, 83, 101; 172/2
See application file for complete search history.

(56) References Cited

U.S. PATENT DOCUMENTS

| | | | | |
|---|---|---|---|---|
| 4,074,672 | A * | 2/1978 | LaDue et al. | 123/198 DC |
| 5,607,254 | A * | 3/1997 | Grembowicz et al. | 404/79 |
| 5,895,172 | A * | 4/1999 | Grembowicz et al. | 404/79 |
| 5,899,630 | A * | 5/1999 | Brock | 404/79 |
| 6,266,596 | B1 * | 7/2001 | Hartman et al. | 701/50 |
| 6,334,735 | B1 * | 1/2002 | Williams et al. | 404/79 |
| 6,421,594 | B1 * | 7/2002 | Erasmus | 701/50 |
| 6,785,596 | B2 * | 8/2004 | Brandt et al. | 701/50 |
| 6,930,591 | B2 * | 8/2005 | Asakage et al. | 340/426.1 |
| 7,019,668 | B2 * | 3/2006 | Kinugawa | 340/870.16 |
| 7,217,062 | B2 * | 5/2007 | Pisano et al. | 404/77 |
| 7,491,012 | B2 | 2/2009 | Weiser | |
| 2005/0167417 | A1 | 8/2005 | Buschmann | |
| 2005/0191127 | A1 * | 9/2005 | Pisano et al. | 404/77 |
| 2006/0045620 | A1 * | 3/2006 | Olson et al. | 404/84.1 |
| 2007/0038355 | A1 * | 2/2007 | Brandt et al. | 701/50 |
| 2007/0138164 | A1 * | 6/2007 | Buschmann | 219/506 |
| 2009/0142133 | A1 | 6/2009 | Glee et al. | |

FOREIGN PATENT DOCUMENTS

| | | |
|---|---|---|
| DE | 29612034 | 9/1996 |
| DE | 29612035 | 9/1996 |
| DE | 19634503 | 3/1998 |
| DE | 29915875 | 12/1999 |
| DE | 29920556 | 2/2000 |
| DE | 29923118 | 3/2000 |
| DE | 20305577 | 8/2004 |
| DE | 102004002658 | 8/2005 |
| DE | 202004016489 | 3/2006 |
| DE | 202007003326 | 4/2007 |
| JP | 038411 | 2/2002 |
| JP | 214212 | 7/2003 |

* cited by examiner

*Primary Examiner* — Matthew D Troutman
(74) *Attorney, Agent, or Firm* — Fish & Richardson P.C.

(57) ABSTRACT

A self-propelling machine for processing bituminous or concrete pavement material, in particular a road finisher or a feeder. The machine comprises an internal combustion engine as a primary drive source, a controller for the engine, said controller receiving control signals, at least one additional drive unit for functional and operational components of the machine as well as at least one hydraulic circuit comprising a hydraulic medium reservoir. The controller is configured for automatically causing starting and/or stopping of the engine in response to receipt of at least one specific control signal.

9 Claims, 1 Drawing Sheet

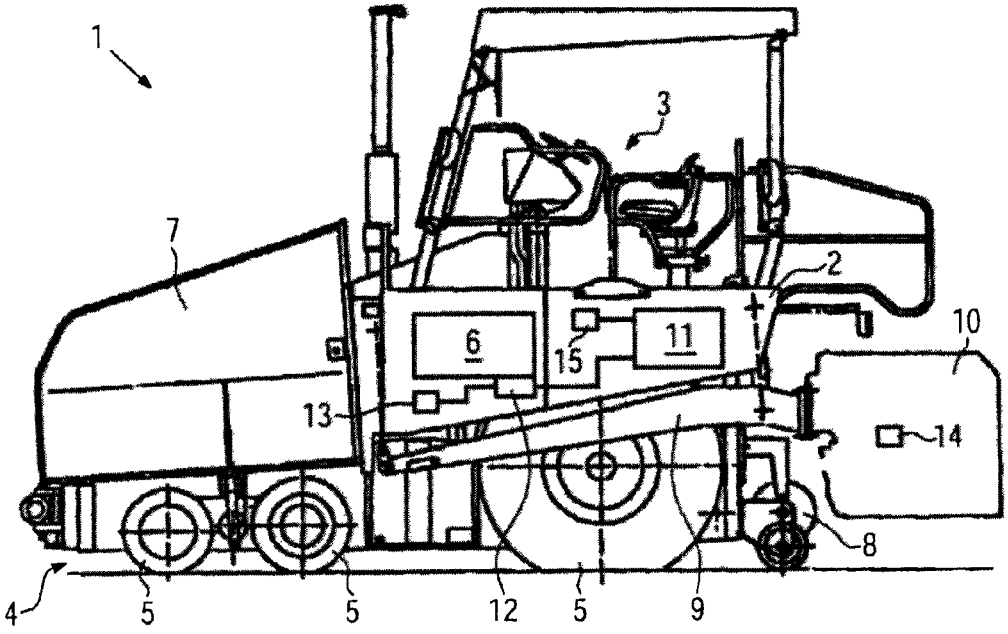
1
3
7
2
10
6
11
15
13
14
8
4
5
5
12
5
9

ROAD FINISHER WITH AUTOMATIC ENGINE CONTROLLER

BACKGROUND OF THE INVENTION

The present invention relates to a self-propelling machine for processing bituminous or concrete pavement material. The self-propelling machine may be a road finisher.

Road finishers are known e.g. from the following publications: DE 20 2007 003 326 U1, DE 20 2004 016 489 U1, DE 10 2004 002 658 A1, DE 299 23 118 U1, DE 299 20 556 U1, DE 299 15 875 U1, DE 296 12 035 U1, DE 296 12 034 U1 or DE 196 34 503 B4. Such road finishers can be driven by a wheel-type running gear, as described in DE 299 20 556 U1, or by a tracked running gear, as described in DE 299 23 118 U1. They are normally provided with a material bunker for accommodating the pavement mix which will form the road surface. With the aid of conveying means, e.g. scraper belts, the pavement mix is conveyed from the material bunker to the area of the road finisher located at the rear when seen in the direction of travel. In this rear area, the pavement mix supplied is distributed across the whole laying width, normally by means of a lateral distributor, e.g. an auger. Finally, the road finisher also carries a so-called screed, which is arranged behind the lateral distributor when seen in the direction of travel. It is used for smoothing and compacting the paving material applied, and, to this end, it may be provided with tampers, vibrating screed plates and/or pressure bars, by way of example.

Road finishers are driven by means of an engine, which is normally an internal combustion engine. In most cases, diesel engines are used. In addition to the driving power, the engine also provides power for operating a generator by means of which current is generated for operating a large number of components of the finisher. The current can, for example, be used for operating the lighting, the control, pumps for hydraulic components and, in particular, electric heating units. Such heating units are normally provided at all the components which come into contact with the pavement mix so as to prevent the latter from cooling down and solidifying on the components of the road finisher. Electric heating elements are especially provided on the screed, since this is the location of the road finisher where the strongest decrease in the temperature of the pavement mix has already occurred.

Due to its weight and the large number of driven components, and also due to the necessity of operating the heating elements, the amount of fuel consumed by a road finisher is comparatively large. In view of the rising energy prices, there is a significant rise in the contribution of the energy costs to the total operational costs of a road finisher. A 10 to 20% reduction of the amount of fuel consumed would already save, per year, several thousand liters of the fuel required for operating a road finisher. This would not only be beneficial to the environment but it would also reduce the operational costs of a road finisher to a significant extent.

BRIEF SUMMARY OF THE INVENTION

It is therefore the object of the present invention to reduce the amount of fuel consumed by a road finisher with the aid of means having the simplest possible structural design.

According to the present invention, this object is achieved by a self-propelling machine, e.g. a road finisher for processing bituminous or concrete pavement material including an internal combustion engine as a primary drive source, a controller for the engine, the controller receiving control signals, at least one pump drive unit, hydraulic-motor drive unit or hydrostatic drive unit for functional and operational components of the machine, and at least one hydraulic circuit comprising a hydraulic medium reservoir. Advantageous further developments of the invention are also disclosed below.

According to the present invention, the controller of the road finisher is configured for automatically causing starting and/or stopping of the engine in response to receipt of at least one specific control signal. According to the present invention, the controller of the road finisher is thus provided with an automatic start device, an automatic stop device or even an automatic start/stop device. This allows the engine to be stopped when specific operating conditions of the road finisher occur and/or it allows the engine to be restarted when other specific operating conditions occur. The fact that the engine is stopped during specific operating phases leads to a substantial reduction in the overall amount of fuel consumed. The automatic starting and/or stopping of the engine offers two additional advantages in comparison with manual starting or stopping: on the one hand, the operating phases allowing a deactivation of the engine are utilized in the best possible manner for accomplishing also a maximum reduction in the amount of fuel consumed. On the other hand, it is not necessary that the operator of the road finisher constantly checks the operating conditions allowing a deactivation of the engine. It follows that the handling of the road finisher will not be impaired in comparison with conventional road finishers.

According to a preferred embodiment, the road finisher is provided with a pushbutton for generating a start-control signal and a stop-control signal, so as to allow the road finisher to be operated in a conventional way. In addition, it is provided with at least one sensor for generating a control signal. This allows an automatic recognition of specific operating conditions of the road finisher, and the subsequent automatic starting and/or stopping of the engine. It is not necessary that the sensor itself is directly configured for generating a control signal, but it may also be configured such that it only transmits a measured variable to an evaluation circuit or an evaluation logic unit, which, in turn, generates the control signal for the engine controller.

It will be expedient when the sensor is a temperature sensor. This means that, depending on the temperature of specific components of the road finisher, the engine can be started and/or stopped. This is of interest especially for operating conditions in which the engine power is used exclusively or almost exclusively for the purpose of heating specific components of the road finisher. When it is recognized in such an operating condition that further heating is not necessary, the engine can be stopped according to the present invention. It is thus possible to save a substantial amount of fuel in comparison with the conventional deactivation of only the heating elements and the continued operation of the engine at the idling speed.

Such a temperature sensor may in particular be configured for measuring the temperature of a screed of the road finisher, or of a part of said screed (e.g. a basic screed, an extendible screed, etc.). Most of the heating power of the road finisher is normally required for the screed. It is, however, not necessary to heat the screed continuously, but heating is only required if the screed temperature dropped below a predetermined threshold. In conventional road finishers only the heating elements were deactivated, whereas the diesel engine continued to operate, as soon as a higher temperature threshold was exceeded. Making use of the present invention, it is now possible that the temperature sensor of the screed transmits a control signal (where appropriate, via a suitable evaluation circuit), in response to receipt of which the controller will cause a deactivation of the engine. Only when the temperature of the screed drops below a predetermined threshold, the engine will automatically be restarted so as to drive the generator and provide thus the electric power for operating the electric heating elements.

According to one variant of the present invention, a timer is provided for generating a control signal for the engine controller. Making use of this timer, it is possible to automatically start and/or stop the road finisher when predetermined time intervals have expired after specific events.

According to an extremely advantageous variant of the present invention, the road finisher comprises a localization and/or navigation system. This localization and/or navigation system can improve the operation of the road finisher in many ways. When the localization measurement is carried out with adequate precision, said localization and/or navigation system may perhaps allow a fully automatic operation of the road finisher.

According to a preferred embodiment, the localization and/or navigation system is so conceived that it is infrared-transmitter-, radio- or satellite-based. All these variants allow a precise, wireless localization and navigation of the road finisher.

It will be particularly advantageous when the localization and/or navigation system is configured for generating a control signal for the controller. In this way, the localization and/or navigation system of the road finisher according to the present invention will not only be able to allow localization and orientation of the road finisher, but it will also be able to cause, through the controller, starting and/or stopping of the engine, when specific operating conditions and ambient conditions exist.

The localization and/or navigation system may, for example, communicate with means for ascertaining the current distance to and/or an expected time of arrival of some other road works vehicle. This other road works vehicle may e.g. be a truck delivering pavement mix which is to be fed to the road finisher. When the road finisher and the other road works vehicle are each provided with a suitable, compatible localization and/or navigation system, the controller of the road finisher will be able to query the current position of the other road works vehicle and calculate from the current distance the expected time of arrival of the approaching road works vehicle. When the engine controller is additionally provided with a clock or a timer, the engine of the road finisher can be started at a suitable moment, so that the screed and the other heated components of the road finisher will have reached the necessary operating temperature precisely when the other road works vehicle arrives. Prior to the heating phase, which is rendered as short as possible in this way, the engine of the road finisher according to the present invention can remain deactivated and substantial amounts of fuel can be saved in this way. Against this background, it will be expedient when the means for ascertaining the current distance to and/or an expected time of arrival of some other road works vehicle is configured for generating a control signal for the engine controller.

According to a preferred embodiment, the road finisher according to the present invention comprises a starting device for starting the engine in response to receipt of a respective control signal, said starting device being e.g. a starter motor, an engine-generator unit (whereby it will no longer be necessary to use a starter motor and a dynamo), a hydraulic starter making use of an accumulator or the like. In this way, the engine controller can start the engine automatically by transmitting the control signal to the starting device.

In this respect, it will be advantageous when a battery is additionally provided so as to be able to supply the starting device with energy also in the deactivated condition of the engine.

BRIEF DESCRIPTION OF THE DRAWING

In the following, an advantageous embodiment of the present invention will be described in more detail making reference to a drawing.

FIG. 1 shows a side view of a road finisher 1 according to the present invention as an example of a self-propelling machine according to the invention.

DETAILED DESCRIPTION OF THE INVENTION

The road finisher 1 is provided with a chassis 2 having arranged thereon the control station 3 of the road finisher 1. The road finisher 1 is movable by means of a running gear 4, which is in the present case a wheel-type running gear 4 with wheels 5. The running gear 4 is driven by means of a diesel engine 6 mounted on the chassis 2 and connected to a generator (not shown) so as to produce electric voltage.

The road finisher 1 additionally comprises a material bunker 7 for accommodating pavement mix, a conveying device (not shown) for conveying the pavement mix from the material bunker 7, underneath the control station 3, to the rear area of the road finisher, and a lateral distributor 8, e.g. an auger, for distributing the pavement mix across the whole laying width in a direction at right angles to the direction of travel of the road finisher 1. The screed 10 is supported on the road finisher 1 on a beam 9 which is adapted to be hydraulically pivoted up and down. It is used for compacting and smoothing the pavement mix discharged.

The road finisher 1 is additionally provided with at least one pump, hydraulic-motor or hydrostatic drive unit (not shown) for functional and operational components of the machine, and with at least one hydraulic circuit comprising a hydraulic medium reservoir.

The road finisher 1 additionally comprises a controller 11 which is configured for automatically causing starting and/or stopping of the engine 6 in response to receipt of at least one control signal. For starting the engine 6, a starting device 12, e.g. a starter motor, is provided, which is supplied with electric power via a an energy store, e.g. a battery 13, independently of the operating condition of the diesel engine 6 and of the generator (not shown). The energy store, e.g. the battery 13, can be charged when the generator is in operation.

Alternatively, the starting device 12 could be a motor-generator unit or a hydraulic starter comprising an accumulator as an energy store.

The controller 11 communicates with a temperature sensor 14 on the screed 10 in a wireless or wire-bound fashion. The temperature sensor 14 measures the temperature of the screed 10. It can transmit a control signal to the controller 11, if the temperature of the screed should exceed or fall below predetermined temperature thresholds.

The engine controller 11 is additionally provided with a localization and navigation system 15. This localization and navigation system 15 is satellite-based (e.g. via GPS) and serves to identify the current position of the road finisher 1. In the present case, it is also configured for communication with a compatible localization and navigation system of some other road works vehicle, e.g. a truck for delivering the pavement mix. The localization and navigation system 15 of the road finisher 1 is able to ascertain the current position of and the distance to the other road works vehicle and, by means of suitable processes, it is able to calculate the expected time of arrival of the other road works vehicle at the road finisher 1. This calculation of the expected time of arrival can be executed in the controller 11.

Operation of the road finisher 1 according to the present invention can take place as described in the following.

In a stand-by mode, the road finisher 1 is stationary at some site and waits for the pavement mix and/or for a signal that the laying operation should begin. In order to be able to start the laying operation as soon as possible, all the heated parts, in particular the screed 10, are maintained at the temperature required for pavement laying by operating the heating elements provided for this purpose. As soon as the temperature sensor 14 provided on the screed 10 (or a further temperature sensor provided on other heated components of the road finisher 1) recognizes that a predetermined temperature threshold, which makes further heating superfluous, has been exceeded, the sensor 14 will report this through a respective control signal to the engine controller 11. The engine controller 11 will then take care that the diesel engine 6 is stopped, since the power of the latter is neither required as a driving power for propelling the road finisher nor is it required for operating the heating elements.

The temperature of the screed 10 will then decrease slowly. When the temperature sensor 14 recognizes that the temperature has fallen below a predetermined threshold, it will report this to the engine controller 11 through another control signal. The engine controller 11 will then cause automatic starting of the engine 6 by means of the starting device 12, e.g. the starter motor, so that the engine 6 can operate the generator and provide thus the electric power for the heating elements. The automatic starting and stopping of the engine 6 during the cooling phases of the screed 10 will save a substantial amount of fuel.

In another situation, the road finisher 1 waits for the arrival of a truck carrying the pavement mix. In this condition, the diesel engine 6 remains deactivated so that no fuel will be consumed. The laying operation should, however, begin as immediately as possible after delivery of the pavement mix.

By means of the localization and navigation system 15, the road finisher 1 is able to identify the current position of the approaching truck so as to determine therefrom the expected time of arrival of the pavement mix. The controller 11 has stored therein information indicating how much time will be necessary for heating the screed 10 to its operating temperature. This enables the controller 11 to start the diesel engine 6 at a suitable moment so that the necessary operating temperature will precisely be reached when the truck arrives. Unnecessarily long heating phases are avoided in this way, and it is also possible to start the laying operation immediately after receipt of the pavement mix.

Taking as a basis the embodiment shown, the road finisher 1 according to the present invention can be modified in many ways. For example, additional sensors may be provided for monitoring specific operating conditions of various components of the road finisher 1, which make it appear advisable to start and/or stop the engine 6.

The invention claimed is:

1. A self-propelling machine for processing bituminous or concrete pavement material, comprising a road finisher having an internal combustion engine as a primary drive source, a controller for the engine, said controller receiving control signals, at least one pump drive unit, hydraulic-motor drive unit or hydrostatic drive unit for functional and operational components of the road finisher, at least one temperature sensor configured for measuring the temperature of a screed of the road finisher or of a part of the screed, and for generating a control signal, at least one hydraulic circuit comprising a hydraulic medium reservoir, the controller being configured for automatically causing starting and/or stopping of the engine in response to receipt of the control signal from the at least one temperature sensor.

2. The machine according to claim 1 including a starting device for starting the engine in response to receipt of a control signal.

3. The machine according to claim 2, including an energy store for supplying the starting device with energy in the deactivated condition of the engine.

4. The machine according to claim 3, wherein the energy store comprises a battery.

5. A self-propelling machine comprising a road finisher for processing bituminous or concrete pavement material, the road finisher comprising a screed, an internal combustion engine as a primary drive source for propelling the road finisher, a controller for the engine, said controller receiving control signals, at least one pump drive unit, hydraulic-motor drive unit or hydrostatic drive unit for functional and operational components of the machine, at least one temperature sensor located on the screed, for generating a control signal, at least one hydraulic circuit comprising a hydraulic medium reservoir, and the controller being configured for automatically causing starting and/or stopping of the engine in response to receipt of the control signal from the at least one temperature sensor.

6. The self-propelling machine of claim 5 which comprises a localization and/or navigation system.

7. The machine according to claim 6 wherein the localization and/or navigation system is configured for generating a control signal for the controller.

8. The machine according to claim 7 including in combination with the localization and/or navigation system means for ascertaining the current distance to and/or an expected time of arrival of some other road works vehicle.

9. The machine according to claim 8 wherein said means are configured for generating a control signal for the controller.

* * * * *